US007337500B2

(12) United States Patent
Schnitzler

(10) Patent No.: US 7,337,500 B2
(45) Date of Patent: Mar. 4, 2008

(54) CARD FLAT BAR FOR A CARDING MACHINE

(75) Inventor: Jürgen Schnitzler, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 535 days.

(21) Appl. No.: 10/972,654

(22) Filed: Oct. 26, 2004

(65) Prior Publication Data

US 2005/0125957 A1 Jun. 16, 2005

(30) Foreign Application Priority Data

Dec. 11, 2003 (DE) ..... 103 58 257

(51) Int. Cl.
*D01G 15/08* (2006.01)

(52) U.S. Cl. ..... 19/113

(58) Field of Classification Search ..... 19/102–104, 19/110, 111, 113

See application file for complete search history.

(56) References Cited

U.S. PATENT DOCUMENTS

| | | | | |
|---|---|---|---|---|
| 4,757,575 | A * | 7/1988 | Varga | 19/103 |
| 4,827,573 | A | 5/1989 | Kuehl | |
| 5,473,795 | A * | 12/1995 | Spix et al. | 19/113 |
| 5,542,154 | A * | 8/1996 | Demuth et al. | 19/114 |
| 5,918,349 | A * | 7/1999 | Leifeld et al. | 19/103 |
| 6,047,446 | A * | 4/2000 | Leder et al. | 19/102 |
| 6,317,931 | B1 * | 11/2001 | Steinert | 19/104 |
| 2002/0088093 | A1 * | 7/2002 | Wust et al. | 19/113 |
| 2003/0033692 | A1 * | 2/2003 | Ebenhoh et al. | 19/114 |
| 2003/0070261 | A1 * | 4/2003 | Pferdmenges | 19/113 |
| 2004/0000034 | A1 * | 1/2004 | Schurenkramer et al. | 19/102 |

FOREIGN PATENT DOCUMENTS

| | | |
|---|---|---|
| DE | 80 31 001.6 U1 | 3/1981 |
| DE | 100 46 916 A1 | 4/2002 |
| DE | 101 40 304 A1 | 2/2003 |
| DE | 102 16 067 A1 | 10/2003 |
| EP | 1 004 692 A2 | 5/2000 |

* cited by examiner

*Primary Examiner*—Shaun R. Hurley
(74) *Attorney, Agent, or Firm*—Venable LLP; Robert Kinberg; Steven J. Schwarz

(57) ABSTRACT

A carding machine, includes a carrier element with a clothing support part (card flat heel). Two end head parts are associated with the carrier element. The carrier element and the end head parts form at least three assembled components, and the end head parts comprise at least one sliding-contact region, which is in contact with the slideway, and at least one fixing region, which is fixed to the carrier element and at the same time holds the sliding-contact region. Between the fixing region of the end head part and at least partial regions of the carrier element there is a distance (clearance), and the distance between the lower limit of the sliding contact region and the card flat heel and/or the free tips of the clothing is adjustable and fixable.

34 Claims, 6 Drawing Sheets

Fig. 3a
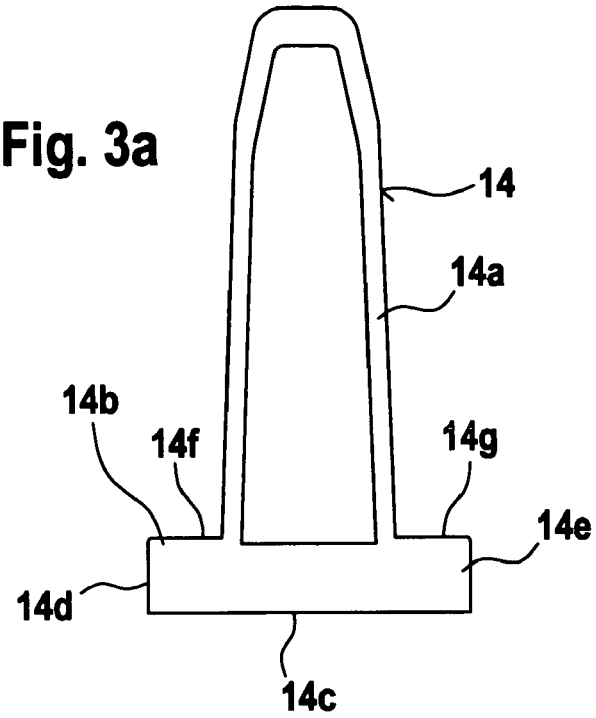
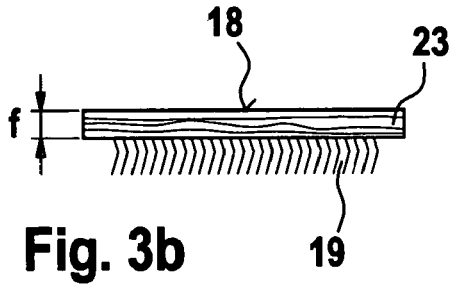
Fig. 3b
Fig. 3c
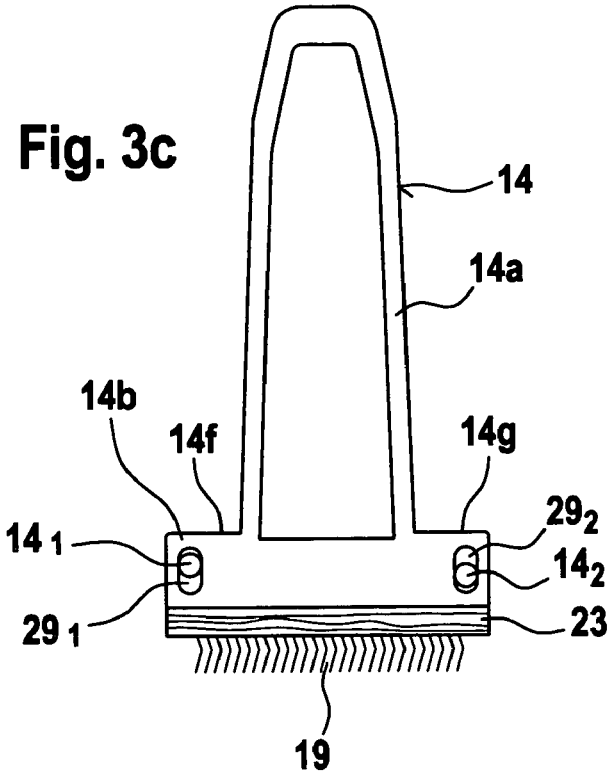

CARD FLAT BAR FOR A CARDING MACHINE

CROSS REFERENCE TO RELATED APPLICATION

This application claims priority from German Patent Application No. 103 58 257.6, dated Dec. 11, 2003, the entire disclosure of which is incorporated herein by reference.

BACKGROUND OF THE INVENTION

The invention relates to a card flat bar for a carding machine, which card flat bar comprises a carrier element with a clothing support part, and two end head parts associated with the carrier element.

In a known card top bar, the carrier element and the end head parts form at least three assembled components, and the end head parts comprise at least one sliding-contact region, which is in contact with the slideway, and at least one fixing region, which is fixed to the carrier element and at the same time holds the sliding-contact region.

Modern card flat bars are extruded from aluminium. In practice, the extruded card flat bar is cut to length and finished, for example, to a flatness of 0.05 mm. Carrier pins are then adhesively secured over part of their area in a tolerance-free plane laterally into openings in the carrier element. On account of the extrusion and the finishing operation, tolerances accrue in the height dimension of the adhesively secured pins. In order to keep this height dimension within a margin of 0.05 mm in a card flat set, after the adhesion process a grading according to height dimensions is carried out. This process takes time and effort. Subsequently, the clothing strip is mounted on the heel face of the card flat bar in the described manner. Since the accumulation of the tolerances from the card flat bar, card flat clothing, offset occurring during mounting and from deformation as a result of tension when fitting on is too high, the above-described levelling by grinding is finally carried out across all the card flat bars. This involves grinding off up to 0.15 mm of material. The technological efficiency of the ground-down clothing tips is limited. If the clothing wire is overground, the actual operative sharpness in the region of the tip is taken away. In particular the accumulation of tolerances as the card flat clothing is assembled, the technically destructive grinding to a level finish and the decline in accuracy during use are therefore disadvantageous.

A card flat bar known from U.S. Pat. No. 4,827,573 comprises a steel tube pulled through a profiling mould. At both ends of the card flat bar there are solid head pieces, on which retaining elements for fixing a drive belt are mounted. These head pieces are joined to the card flat bar either by welding or with rivets or screws, so that they can be exchanged when they have become ineffectual as a result of wear. It has become apparent that the weld joints in some cases lead to stresses in the card flat bar and then exchange of the entire card flat bar is necessary. This same applies also to the screwed and riveted joint, that is, the joining force to be applied (turning the screw or the pressure involved in riveting) must be uniform to begin with and remain constant within a certain tolerance range for all card flat bars, in order to avoid undue compressive strain (i.e. a plastic deformation of the bar length by compression). Consequently, the height dimensions between slideway and clothing tips for all card flat bars of a card flat set are not equal. The known card flat bar has lateral walls that extend downwardly and parallel to a certain level and then converge. The end head piece consists of three elements, the head piece and the two-part holding element, which are arranged axially in relation to the carrier element. Only the head piece slides on the slideway, whereas the holding elements and the drive element are located away from the slideway. The drawback of this arrangement is that the drive element acting outside the slideway exerts an undesirable lever action, and hence a bending moment, on the head piece and on the carrier element. In addition, in this way the head piece does not slide with dimensional accuracy on the slideway, and disruptive tilting can occur. The manufacture of the carrier element from a steel tube, which is cold-drawn through a profiling mould and subsequently has to be heat-treated, is associated with considerable outlay, both in relation to manufacturing costs and from a technological point of view. Finally, it is particular disadvantage that the head pieces become worn during in operation. The effort involved in exchange of the worn head pieces is considerable, since the welded or riveted joints of the head pieces to the carrier element have to be unfastened and then reinstated again after the replacement. The repair can only be carried out when the carding machine is idle, which leads to considerable disruption to operations and to production losses.

It is an aim of the invention to produce a device of the kind described in the introduction that avoids or mitigates the said disadvantages, in particular in a simple manner renders possible a dimensionally stable and dimensionally accurate clothed card flat bar and allows simpler manufacture.

SUMMARY OF THE INVENTION

The invention provides a card flat bar assembly for use in a carding machine, comprising:

a carrier element having a clothing support portion and a back portion, and first and second opposed ends; and first and second end head parts for fixing to said first and second opposed ends of said carrier element, each end head part comprising at least one fixing region and at least one sliding region having a sliding surface that in use is in sliding contact with a slideway of the carding machine;

wherein the fixing region can be adjusted in position relative to the carrier element for adjusting a distance between said sliding surface and a lower surface of the assembled card flat bar and can be fixed at a desired position.

Said distance between said sliding surface and a lower surface of the assembled card flat bar may be a distance between said sliding surface and a lower surface of the clothing support portion, or may be a distance between said sliding surface and a further layer or component attached to the clothing support, for example, a distance between the sliding surface and tips of clothing provided on the clothing support. The fixing region may be adjustable in position relative to the carrier element by means, in particular, of there being a separation distance between the fixing region and that part of the carrier element with which it engages, permitting a degree of play between the fixing region and the carrier element.

Where, in a preferred embodiment, there is a clearance between the outer wall of the fixing region and the inner wall of an opening in the carrier element, the distance between the sliding-contact surface and the card flat tips is uniformly and equally precisely adjustable for each card flat bar, and this distance can be fixed, thus enabling a dimensionally accurate card flat bar to be produced in a simple manner. All manufacturing tolerances of the card flat bar, the clothing and during assembly (including dismantling) can be eliminated. The card flat bar clothed in accordance with the invention advantageously and effectively reduces or prevents an accumulation of tolerances during assembly of the card flat clothing, the technically destructive grinding to a level finish and the decline in accuracy during use. In particular it is an advantage that the measures according to the invention render grading of the card flat bars according to class unnecessary, as a result achieving quite considerable rationalisation. The height dimensions achieved within a card flat set comprising a plurality of card flat bars are identical.

The end head part may be in direct engagement with the carrier element. The end head part may be in engagement with the carrier element by way of an auxiliary support known per se in the region of the end face. Each end head may comprise two elements. The sliding-contact region of the end head part may be of substantially linear construction. The sliding-contact region may be in the form of a sliding-contact surface.

The fixing region may be, for example, cylindrical or polygonal. The end head parts may be fixed in the end face of the heel part of the carrier element. The end head parts may be of any suitable material, for example, hardened steel or the like. Advantageously, the sliding-contact surface of the end head parts is ground, precision-ground and/or polished. Advantageously, the end head parts are fixed in openings of the carrier element. Preferably, the end head parts are fixed with their fixing region in a bore in the end face of the carrier element. Advantageously, the lower limitation of the fixing regions of the end head parts is located a distance above the heel face of the carrier element. Advantageously, openings are present in the heel part of the carrier element extending over the length thereof. Advantageously, the openings run parallel to one another. Advantageously, the openings have a continuous slit (elongate slot open on one side). The cross-section of the openings may be, for example, circular, polygonal, or elongate. Advantageously, the carrier element and the end head parts form at least three assembled components. Advantageously, the carrier element is an extruded profile, which may be hollow. The lower regions may slide on the slideways of the end head parts. The end head parts may be connected to the openings by an interference fit. The end head parts may be connected to the openings by resilient clamping. A bonding and filling material may be present between the end head parts and the openings. The end head parts may be connected with or in the openings by means of a casting compound or the like. The end head parts may be connected to the openings by being adhesively secured therein. The end head parts may be connected to the openings by a curable synthetic resin or the like. The end head parts may be connected to the openings by a mechanical fixing element or the like.

When a card flat bar of the invention has a card flat clothing, in which the card flat clothing is fixed to the card flat bar and lies opposite the clothing of a roller, e.g. the cylinder, there may be present, between the card flat bar and the card flat clothing, a compensating layer, which is capable of compensating for different distances between the card flat bar and the card flat clothing. The compensating layer may be capable of compensating for different distances between the rear face of the card flat clothing and the heel face of the card flat bar. The compensating layer may be capable of compensating for different distances between the sliding-contact surfaces of the card flat heads and the heel face of the card flat bar. The compensating layer may be capable of compensating for different distances between the sliding-contact surfaces of the card flat heads and the tip circle of the clothing tips. The compensating layer may be capable of compensating for different distances between the tip circle of the clothing tips and the tip circle of the cylinder clothing. The compensating layer may be capable of compensating for local different distances between the rear face and the heel face. The compensating layer may consist of plastics material or the like. For example, a synthetic resin, e.g. epoxy resin, or a polyester or the like may be provided as compensating compound. The plastics material, the synthetic resin or the like may be curable; may be castable; and/or may be viscous. Advantageously, the plastics material, the synthetic resin or the like adheres to the clothing backing more strongly than to the heel face of the card flat bar. Advantageously, an adhesive layer is present between the compensating layer and the heel face of the card flat bar.

Advantageously, a flexible clothing is present. The flexible clothing may comprise a backing and clothing tips, wires, hooks or the like. The backing may be in the form of a strip. The clothing may consist of saw-tooth wire strips, e.g. all-steel clothing. The clothing may be secured to the card flat bar in the region of the heel face thereof. The clothing may be secured to the card flat bar by adhesion. Advantageously, the card flat bar and the card flat clothing can be associated with the same reference plane. The reference plane may be a flat counter-surface, e.g. a plate or the like, for the tips of the card flat clothing. The card flat bar may be an extruded profile of light metal, e.g. aluminium. The extruded profile may be a hollow profile. The carrier element may be cut to length, e.g. by sawing. The cut-to-length card flat bar can be straightened. In use, the distance between the sliding-contact surfaces of the card flat heads on the outer face of the slideway and the envelope curve of the card flat clothing tips is uniform. The end parts may be non-releasably connected to the card flat heel. Advantageously, the fixing region of the end head part is fixed in an opening of the carrier element. Advantageously, a distance (degree of play) is present between the fixing region of the end head part and at least partial regions of the inner wall of the opening.

The invention also provides a card flat bar for a carding machine, which card flat bar comprises a carrier element with a clothing support part (card flat heel) and a back part, wherein two end head parts are associated with the carrier element, the carrier element and the end head parts form at least three assembled components, and the end head parts comprise at least one sliding-contact region, which is in contact with the slideway, and at least one fixing region, wherein between the fixing region of the end head part and regions of the card flat heel there is a distance (clearance), and the distance between the lower limit of the sliding contact region and regions of the card flat heel and/or the free tips of the clothing is adjustable and fixable.

In one method of manufacture of card top bars according to the invention, a plurality of card flat bars are arranged with their heel face on a common reference plane, the sliding elements are likewise arranged with their sliding-contact surface on a common reference plane and subsequently the sliding elements thus adjusted are fixed in the card flat bar. The surface of the cylinder clothing may be used as a reference surface for alignment of the card flat bar and the card flat clothing. The card flat tips may be placed on the first said reference plane and the card flat heads may be placed on the second said reference plane, an intermediate layer being applied between the carrier element and the clothing strip.

In a device for manufacture of a card flat bar according to the invention, the clothing tips of a plurality of card flat bars can be arranged on a common reference plane, the sliding-contact regions of the sliding-contact elements can be likewise arranged on a common reference plane and subsequently the sliding-contact elements adjusted in this manner can be fixed in the card flat bar. The distance between the reference planes may be adjustable. The device may include a plate, for example, a magnetic plate. The device may include as a reference plane, for example, a piece of flat metal or the like. The plate and the reference plane may be mounted on a common holding element.

BRIEF DESCRIPTION OF THE DRAWINGS

FIG. 3*a* is a side view of a back part and a carrier element of a card flat bar according to the invention;

FIG. 3*b* is a side view in section through a clothing strip;

FIG. 3*c* is a side view of a the card flat bar according to the invention in its assembled state;

DETAILED DESCRIPTION OF PREFERRED EMBODIMENTS

Figure 1:
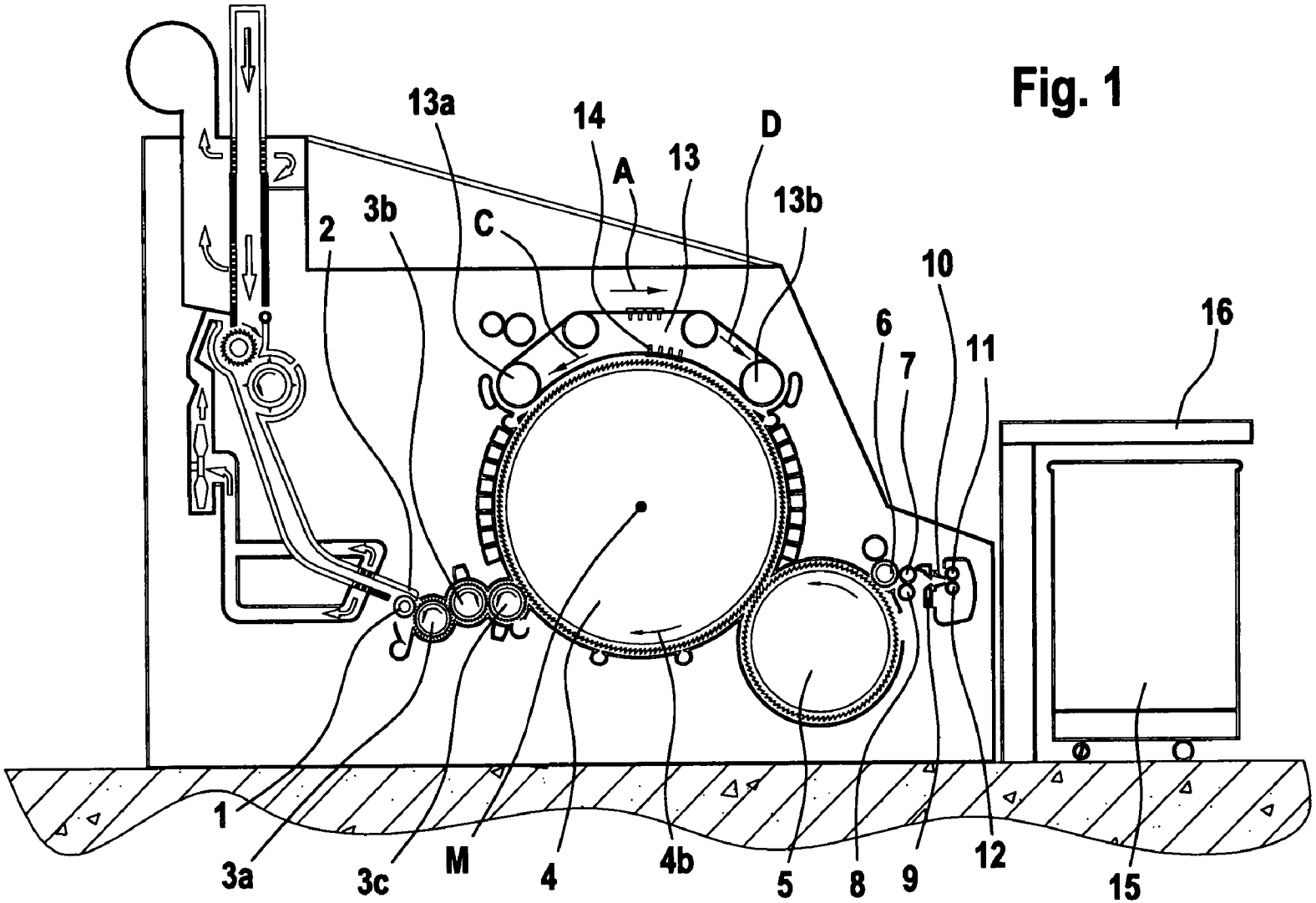
FIG. 1 is a schematic side view of a carding machine with a device according to the invention.

With reference to FIG. 1, a carding machine, for example, a TC 03 card made by Trutzschler GmbH & Co. KG of Monchengladbach, Germany, has a feed roller 1, feed table 2, licker-ins 3*a*, 3*b*, 3*c*, cylinder 4, doffer 5, stripping roller 6, squeezing rollers 7, 8, web-guide element 9, web funnel 10, take-off rollers 11, 12, revolving card flat 13 with card flat guide rollers 13*a*, 13*b* and card flat bars 14, can 15 and can coiler 16. The directions of rotation of the rollers are shown by respective curved arrows. The letter M denotes the midpoint (axis) of the cylinder 4. The reference numeral 4*a* denotes the clothing and 4*b* denotes the direction of rotation of the cylinder 4. The letter C denotes the direction of rotation of the revolving card flat 13 in the carding setting and the letter D the return transport direction of the card flat bars 14.

Figure 2:
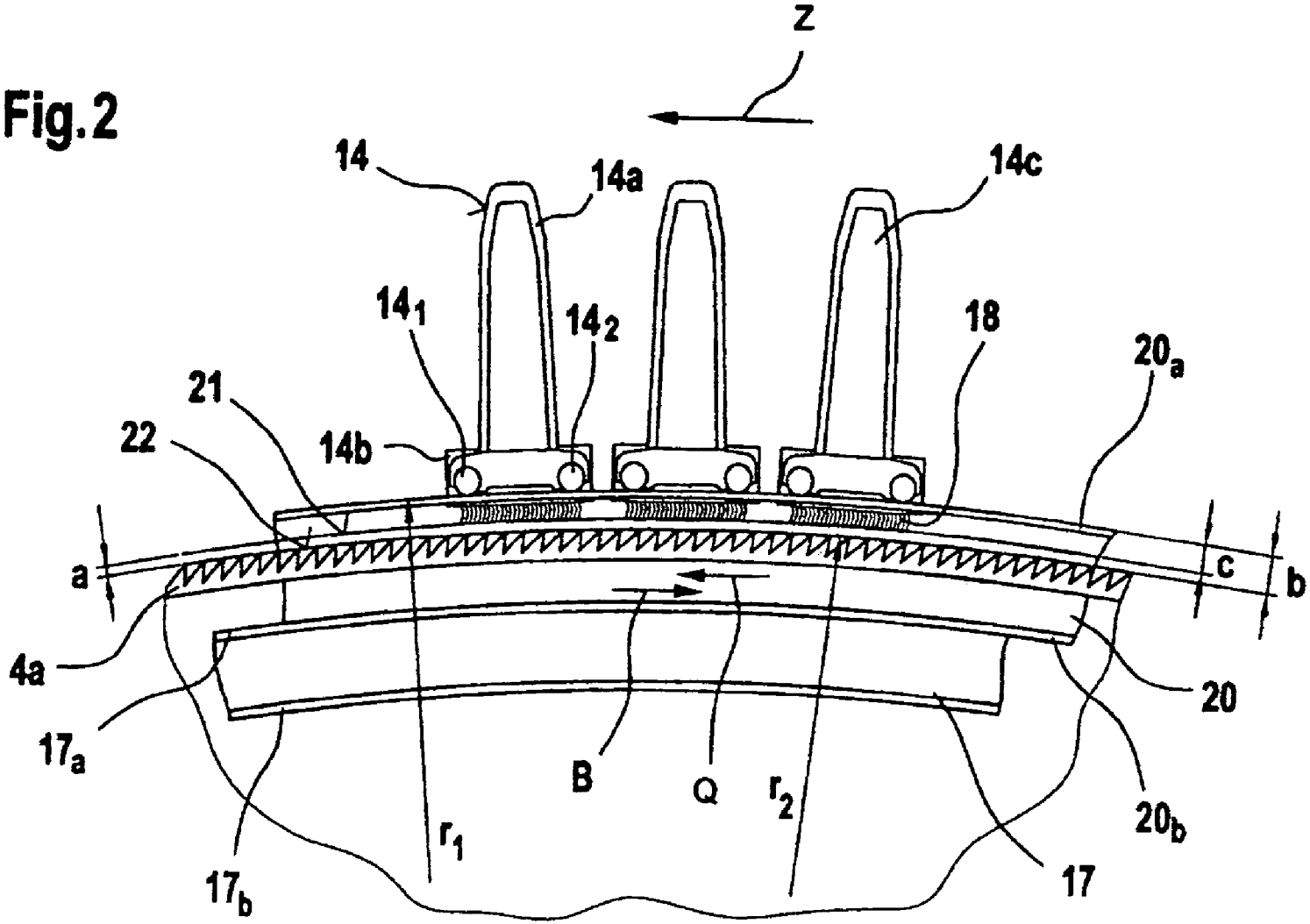
FIG. 2 is a side view of a number of card flat bars with a fragment of a slideway and a flexible bend respectively.

Referring to FIG. 2, on each side of the carding machine, a flexible bend 17 having several adjusting screws is secured laterally to the machine frame. The flexible bend 17 has a convex outer surface 17*a* and a lower surface 17*b*. Above the flexible bend 17, there is a first slideway 20, for example, of anti-friction plastics material, which has a convex outer surface 20*a* and a concave inner surface 20*b*. The concave inner surface 20*b* lies on the convex outer surface 17*a* and is able to slide thereon in the direction of the arrows B, Q. Each card flat bar, which may be constructed in accordance with EP 0 567 747 A1, for example, consists of a back part 14*a* and a carrier element 14*b*. The carrier element 14*b* has a heel face 14*c*, two lateral faces 14*d*, 14*e* and two upper faces 14*f*, 14*g* (see FIG. 3). Each card flat bar 14 has at both ends a respective card flat head 14', 14" (see FIG. 8), each of which comprises two steel pins $14_1$, $14_2$ and $14_3$, $14_4$ respectively, which with a portion thereof are secured axially (see length 1 in FIG. 8) in a compensating layer 24. The parts of the steel pins $14_1$, $14_2$ that project beyond the end faces of the carrier element 14*b* slide on the convex outer surface 20*a* of the slideway 20 in the direction of arrow Z. The clothing strip 18 is mounted on the lower surface of the carrier element 14*b*. The reference number 21 denotes the tip circle of the card flat clothings 19. On its circumference, the cylinder 4 has a cylinder clothing 4*a*, for example, saw-tooth clothing. The reference numeral 22 denotes the tip circle of the cylinder clothing 4*a*. The distance between the tip circle 21 and the tip circle 22 is denoted by the letter a, and is, for example, 3/1000'. The distance between the convex outer surface 20*a* and the tip circle 22 is denoted by the letter b. The radius of the convex outer surface 20*a* is denoted by $r_1$ and the radius of the tip circle 22 is denoted by $r_2$. The radii $r_1$ and $r_2$ intersect at the mid-point M of the cylinder 4.

FIG. 3*a* shows a carding flat bar 14, which is extruded from aluminium, consists of the back part 14*a* and the carrier element 14*b*. According to FIG. 3*b*, a clothing strip 18 for the bar of FIG. 3*a* consists of clothing tips 19 (wire hooks) and a backing element 23 of a textile material. The thickness of the backing element 23 is denoted by the letter f. The wire hooks 19 are secured in the backing element 23, with one end passing through the surface 23' thereof. The other ends of the wire hooks 19, the clothing tips, are free. FIG. 3*c* shows the card flat bar 14 corresponding to FIGS. 3*a* and 3*b* in the assembled state. There are openings in the carrier element 14*b* (heel part) are in the form of slots, in which the card flat pins $14_1$, $14_2$ are arranged. The card flat pins $14_1$, $14_2$ are fixedly connected with the inner walls of the openings by means of a curable casting compound $29_1$, $29_2$ respectively.

The curable casting compound $29_1$, $29_2$ is able to compensate for different distances between the card flat bar 14, namely the heel face 14*c*, and the card flat clothing 19, namely the envelope of the free tips. The fixing regions of the steel pins $14_1$, $14_2$ that form the card flat head 14' are arranged in respective openings 281, 282 (see FIG. 4*a*). The sliding-contact region of the steel pins $14_1$, $14_2$ extends beyond the end face (see FIGS. 5 to 7).

Figure 4A:
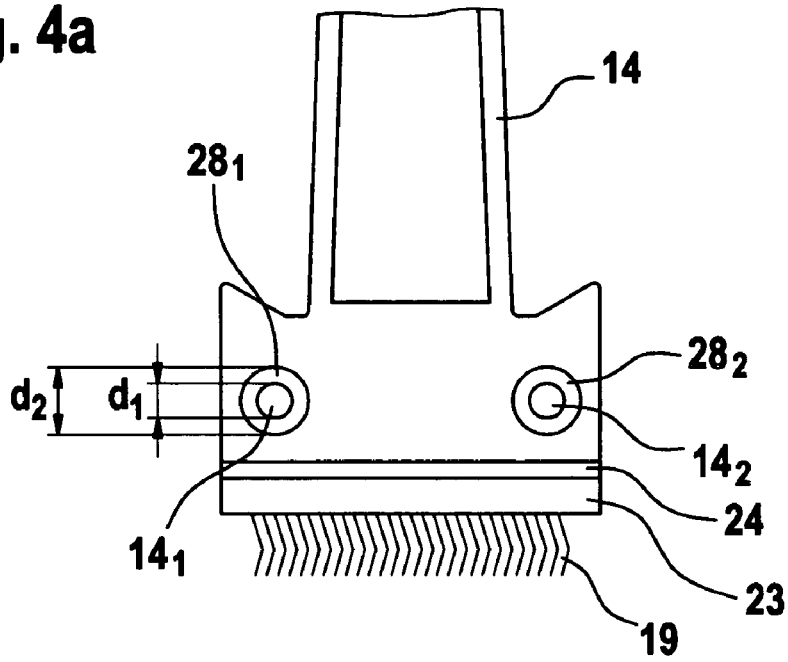
FIG. 4*a* is a section through another card flat bar with the card flat pins inserted.
Figure 4B:
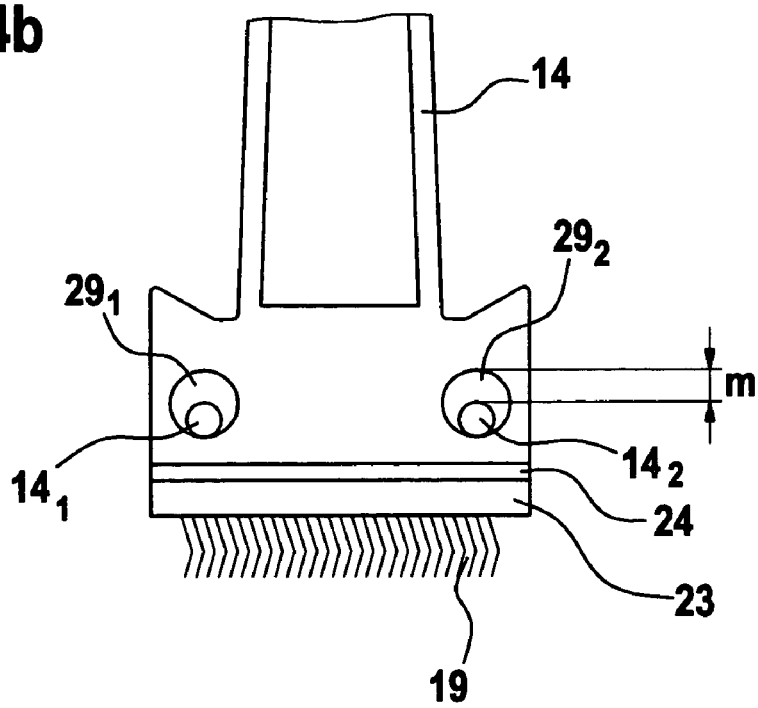
FIG. 4*b* is a section through the card flat bar of FIG. 4*a* with the card flat pins fixed in position.

In the embodiment of FIGS. 4*a* and 4*b*, the openings $28_1$, $28_2$ in the card flat bar are of hollow cylindrical construction. The outer diameter $d_1$ of the pins $14_1$, $14_2$ is smaller than the inner diameter $d_2$ of the fixing openings $28_1$, $28_2$. Between the fixing region i (see FIG. 5) of the card flat pins $14_1$, $14_2$ and the openings $28_1$, $28_2$, there is a distance m (clearance), i.e. $d_2$-$d_1$=m. According to FIG. 4*a*, the pins $14_1$, $14_2$ are inserted in the openings $28_1$, $28_2$ with their fastening region i (see FIGS. 5 to 7). According to FIG. 4*b*, a curable casting compound (hardened) $29_1$, $29_2$ is present in the bores $28_1$, $28_2$ respectively. The pins $14_1$, $14_2$ in FIG. 4*b* are shown in end positions.

Figure 5:
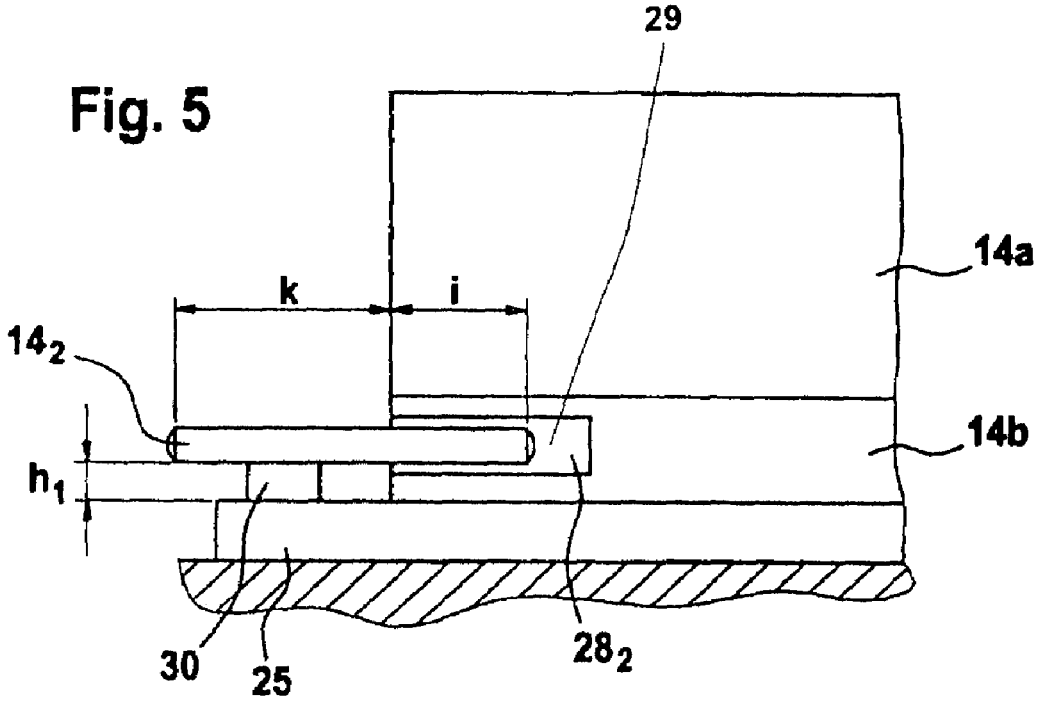
FIG. 5 is a front view of a card flat bar carrier showing the adjustment of the distance between the lower limit of the card flat pin and the lower limit of the card flat heel.
Figure 6:
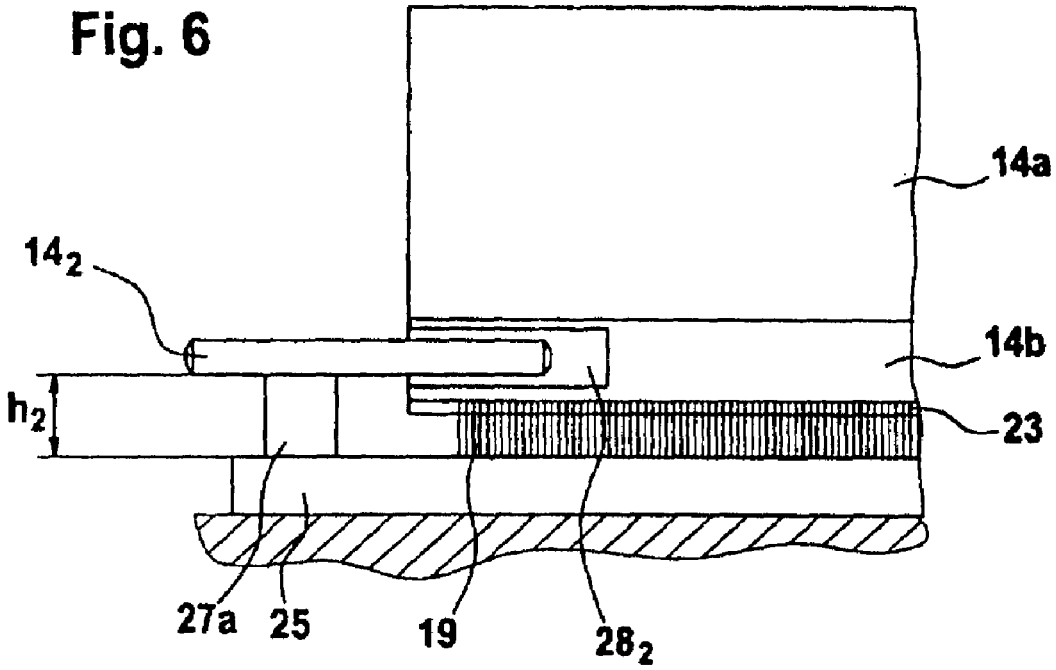
FIG. 6 is a front view of a card flat bar showing adjustment of the distance between the lower limit of the card flat pin and the free clothing tips.

Referring to FIGS. 5 and 6, the card flat pin $\mathbf{14}_2$ is arranged with its fixing region i in the opening $\mathbf{28}_2$ and the sliding-contact region k—the free end—is located outside the opening $\mathbf{28}_2$.

As shown in FIG. 5, a parallelepipedal bearing element 30 having parallel plane surfaces is arranged between the lower limit of the card flat pin $\mathbf{14}_2$ and a flat plate 25. By means of this device, the preset distance $h_1$ between the lower limit of the sliding-contact region k of the card flat pin 142 and the lower limit 14*c* of the card flat heel 14*b* is set. First of all the card flat heel 14*b* is placed on the plate 25. The card flat pin $\mathbf{14}_2$ is then applied in such a way that the sliding-contact region k lies on the bearing element 30 and the fixing region i is arranged in the opening $\mathbf{28}_2$. Finally, the curable casting compound 29 is introduced into the opening $\mathbf{28}_2$ and hardened. Once the clothing strip has been fastened to the surface 14*c*, a preset uniform distance between the sliding-contact surface of the card flat pins and the clothing tips is realised.

FIG. 6 shows the adjustment of the distance $h_2$ between the lower limit of the sliding-contact region k of the card flat pin $\mathbf{14}_2$ and the free tips of the clothing 19. The adjustment corresponds substantially to the adjustment shown in FIG. 5, but first of all the clothing strip 23 is fixed to the heel face 14*c*, the card flat bar 14 with the tips of the clothing 19 is placed on the plate 25 and then the card flat pin is applied and fixed in the manner specified with reference to FIG. 5, using a bearing element 27*a* instead of bearing element 30.

Figure 7:
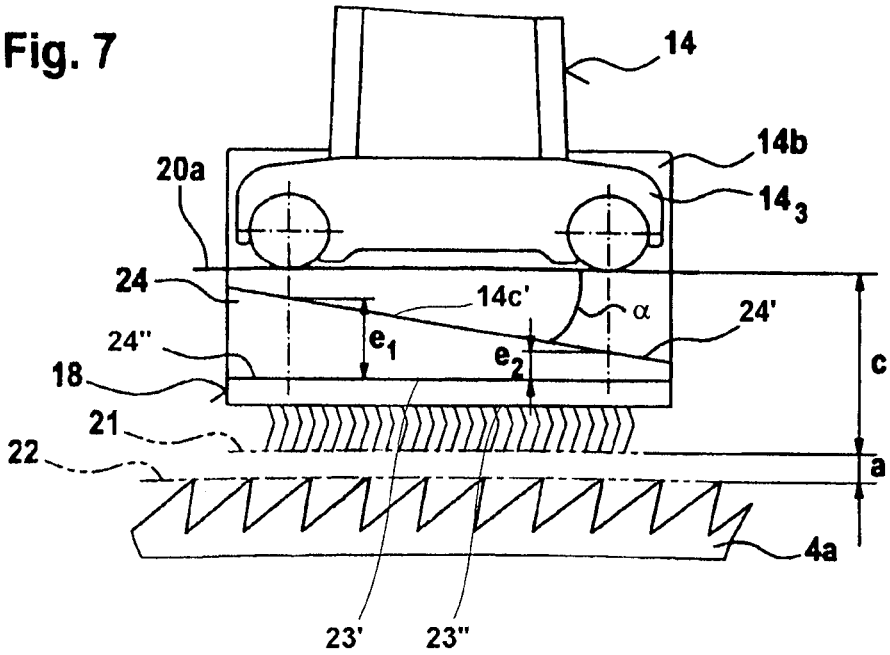
FIG. 7 is a side view of a further embodiment with an additional compensating layer between card flat heel and clothing strip.

In the card flat bar of FIG. 7, an intermediate layer 24, for example, of cured synthetic resin, is arranged between the carrier element 14*b* and the backing element 23. The upper surface 24' lies in contact with the heel face 14*c'* and the lower face 24" lies in contact with the backing element. The upper face 24' is also arranged at an angle $\alpha$ to the carrier element 14*b*. The lower face 24" on the other hand is aligned parallel to the connecting line between the sliding-contact points of the pins $\mathbf{14}_1$, $\mathbf{14}_2$ and the tip circle 21. In this way, the distance c between the sliding-contact points of the pins $\mathbf{14}_1$, $\mathbf{14}_2$ and the sliding-contact surface 20*a* on the one hand and the tip circle 21 (envelope curve) of the card flat pins $\mathbf{14}_1$, $\mathbf{14}_2$ on the other hand is uniform. The different distances $e_1$, $e_2$ between the faces 14*c'* and 23' are compensated for by the compensating layer 24. In this manner—despite the undesirably sloping heel face 14*c'* of the carrier element 14*b*—the important and narrow carding distance a between the tip circle 21 of the card flat clothing 19 and the tips 22 of the cylinder clothing 4*a* is constant on all sides. $\mathbf{14}_3$ denotes a connecting element that is fixed with a positive fit to the pins $\mathbf{14}_1$, $\mathbf{14}_2$.

The compensating layer 24 similarly compensates for local irregularities in the heel face 14 of the carrier element 14*b* or in the face 23' of the backing element 23 or any variation from parallel that exists between the distances of the tip circle 21 to the surface 23' and/or to the face 23".

Figure 8:
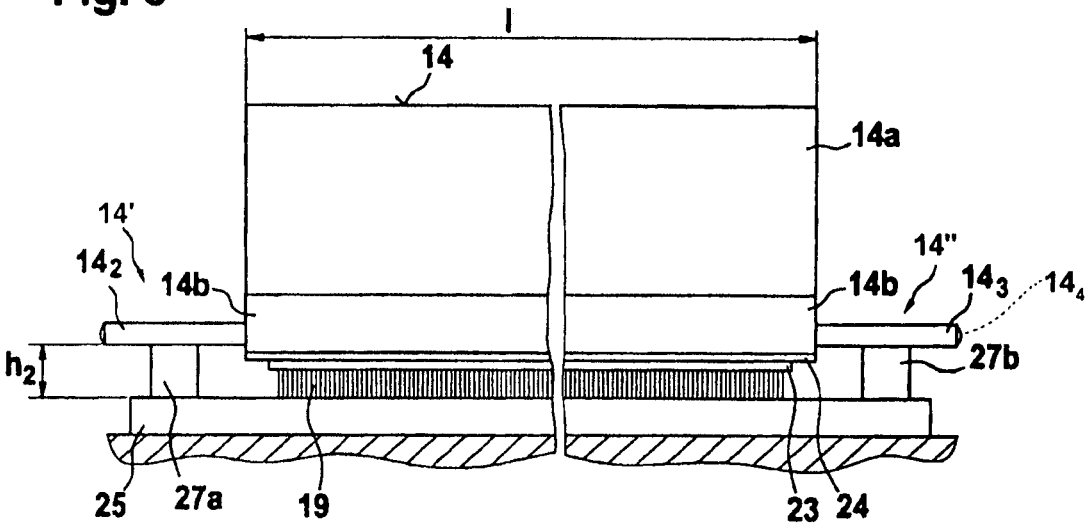
FIG. 8 is a front view, partially in section, of a construction according to the invention with an arrangement for aligning the card flat bar (distance between card flat pin and clothing tips).

As FIG. 8 shows, between the card flat pins $\mathbf{14}_1$, $\mathbf{14}_2$ and a flat plate 25 there is fixedly arranged on the plate 25 a parallelepipedal bearing element 27*a* with parallel and plane faces, and between the card flat pins $\mathbf{14}_3$, $\mathbf{14}_4$ (hidden behind pin $\mathbf{14}_3$) and the plate 25 there is fixedly arranged on the plate 25 a further parallelepipedal bearing element 27*b* of the same height h. With this device, and with (not shown) further lateral infill elements or the like (e.g. displaceable limiting faces for the compensating layer 24 and/or the backing element 23), the clothing tips 19 of the clothing strip 18 can be positioned on the plate 25 and pins $\mathbf{14}_1$, $\mathbf{14}_2$, $\mathbf{14}_3$, $\mathbf{14}_4$ can be positioned on the bearing elements 27*a*, 27*b*. The compensating layer 24 is subsequently introduced between the carrier 14*b* and the backing element 23. This can be effected, for example, in that the compensating layer is cast, injected, spread, placed in position etc. The compensating layer 24, for example of paste-like composition, then distributes itself in the space and fills this evenly.

Although the foregoing invention has been described in detail by way of illustration and example for purposes of understanding, it will be obvious that changes and modifications may be practised within the scope of the appended claims.

What is claimed is:

1. A card flat bar assembly for use in a carding machine, comprising:

a carrier element having a clothing support portion and a back portion, and first and second opposed ends; and first and second end head parts for fixing to said first and second opposed ends of said carrier element, each end head part comprising at least one fixing region and at least one sliding region having a sliding surface that in use is in sliding contact with a slideway of the carding machine;

wherein the fixing region can be adjusted in position relative to the carrier element for adjusting a distance between said sliding surface and a lower surface of the assembled card flat bar and can be fixed at a desired position.

2. A card flat assembly according to claim 1, in which a distance between the sliding surface and a heel surface of the clothing support portion is adjustable.

3. A card flat top assembly according to claim 1, further comprising a clothing which can be secured to the clothing support portion, in which a distance between the sliding surface and free tips of the clothing is adjustable.

4. A card flat bar according to claim 1, in which the or each fixing region is a cylinder.

5. A card flat bar according to claim 1, in which the or each fixing region is of polygonal cross-section.

6. A card flat bar according to claim 1, in which the end head parts are fixed in the end face of the clothing support portion.

7. A card flat bar according to claim 1, in which the end head parts are fixed in openings of the carrier element.

8. A card flat bar according to claim 1, in which the end head parts are fixed with the or each fixing region in a bore in an end face of the carrier element.

9. A card flat bar according to claim 1, in which the lower extremity of each end head part is located above a heel face of the carrier element.

10. A card flat bar according to claim 1, comprising openings in the heel part of the carrier element extending continuously over the length thereof.

11. A card flat bar according to claim 10, in which the openings run parallel to one another.

12. A card flat bar according to claim 10, in which the openings have a continuous slit.

13. A card flat bar according to claim 10, in which the openings are of circular, polygonal or elongate cross-section.

14. A card flat bar according to claim 10, in which the or each fixing region of the end head parts can be fixed in a respective opening of the carrier element.

15. A card flat bar according to claim 14, in which the diameters of the fixing regions are smaller than the diameters of the corresponding openings, whereby there is play between the fixing regions and the openings before the fixing regions are fixed in the selected position.

16. A card flat bar according to claim 1, in which the carrier element is a hollow, extruded profile.

17. A card flat bar according to claim 1, in which the end head parts are connectable to the carrier element by an interference fit or by resilient clamping.

18. A card flat bar according to claim 1, in which a bonding and filling material is present between the fixing regions at the end head parts and openings in the carrier element for affixing the fixing regions therein.

19. A card flat bar according to claim 1, in which fixing regions of the end head parts are connected with or in openings of the carrier element by means of a casting compound of the like.

20. A card flat bar according to claim 1, in which fixing regions of the end head parts are connected to openings of the carrier element by being adhesively secured therein.

21. A card flat bar according to claim 1, in which fixing regions of the end head parts are connected to openings of the carrier element by a curable synthetic resin or the like.

22. A card flat bar according to claim 1, in which fixing regions of the end head parts are connected to openings of the carrier element by a mechanical fixing element or the like.

23. A card flat bar according to claim 1, having a card flat clothing, in which the card flat clothing is fixed to the card flat bar and between the card flat bar and the card flat clothing a compensating layer is present, which is capable of compensating for different distances between the card flat bar and the card flat clothing.

24. A card flat bar according to claim 23, in which the compensating layer adheres to the clothing backing more strongly than to the heel face of the card flat bar.

25. A card flat bar according to claim 23, in which an adhesive layer is present between the compensating layer and the heel face of the card flat bar.

26. A card flat bar according to claim 1, in which in use of the assembled bar the distance between the sliding-contact surfaces of the card flat heads on the outer face of the slideway and the envelope curve of the card flat clothing tips is uniform.

27. A card flat bar according to claim 1, in which the end head parts are non-releasably connectable to the carrier element.

28. A card flat bar according to claim 1, which is part of a revolving card flat.

29. A card flat bar according to claim 1, which is a stationary carding element.

30. A card flat bar for a carding machine, which card flat bar comprises:

a carrier element with a clothing support part (card flat heel), first and second opposed ends, and a back part, first and second end head parts associated with the carrier element, wherein the carrier element and the end head parts form at least three assembled components, and each of the end head parts comprises at least one sliding-contact region, which is in contact with the slideway, and at least one fixing region, which is fixed in the respective one of the first and second opposed ends of the carrier element and at the same time holds the sliding-contact region, wherein between the fixing region of each end head part and regions of the card flat heel there is a first distance (clearance), and a second distance between a lower surface of the sliding contact region and regions of the card flat heel and/or the free tips of the clothing is adjustable and fixable.

31. A device for manufacture of a card flat bar according to claim 1, comprising a first surface providing a first common reference plane upon which clothing tips of a plurality of card flat bars can be arranged, a second surface providing a second common reference plane upon which contact elements of end head parts can be arranged for adjusting the sliding-contact elements relative to the carrier element for subsequent fixing therein.

32. A device according to claim 31, in which the distance between the reference planes is adjustable.

33. A method of making card flat bars comprising:

arranging a plurality of card flat bar carrier elements with their heel face on a common reference plane, each flat bar carrier element having first and second opposed ends, positioning opposed first and second end head parts, having sliding-elements with a sliding contact surface, in a desired position relative to the first and second opposed ends, respectively, of each said carrier element by arranging the sliding contact surfaces in a second common reference plane, and subsequently fixing the first and second end head parts, so positioned, to the first and second opposed ends, respectively, of the carrier elements.

34. A method according to claim 33, in which the carrier elements including clothing of which the clothing tips are placed on the first reference plane and the card flat heads are placed on the second reference plane and an intermediate layer is applied between the carrier element and the clothing strip.

* * * * *